US007398861B2

(12) United States Patent
Rossignol et al.

(10) Patent No.: US 7,398,861 B2
(45) Date of Patent: Jul. 15, 2008

(54) ELEVATOR MONITORING UNIT AND PROCEDURE FOR THE MAINTENANCE OF AN ELEVATOR UNIT

(75) Inventors: Eric Rossignol, Dietwil (CH); Marco Aluisetti, Locamo (CH)

(73) Assignee: Inventio AG, Hergiswil NW (CH)

( * ) Notice: Subject to any disclaimer, the term of this patent is extended or adjusted under 35 U.S.C. 154(b) by 551 days.

(21) Appl. No.: 11/131,542

(22) Filed: May 18, 2005

(65) Prior Publication Data

US 2005/0252724 A1 Nov. 17, 2005

(30) Foreign Application Priority Data

Nov. 18, 2002 (EP) ..... 02405988

(51) Int. Cl.
*B66B 13/14* (2006.01)

(52) U.S. Cl. ..... 187/314; 187/276

(58) Field of Classification Search ..... 187/254, 187/256, 272, 276, 277, 391–394, 313, 314, 187/316, 317, 413, 414
See application file for complete search history.

(56) References Cited

U.S. PATENT DOCUMENTS

| | | | | |
|---|---|---|---|---|
| 5,740,888 | A * | 4/1998 | Aulanko et al. | 187/336 |
| 6,223,860 | B1 * | 5/2001 | Namba et al. | 187/277 |
| 6,321,877 | B2 * | 11/2001 | Yamakawa | 187/391 |
| 6,336,523 | B1 * | 1/2002 | Ozeki et al. | 187/391 |
| 6,378,660 | B1 * | 4/2002 | Adifon et al. | 187/272 |
| 6,484,850 | B1 * | 11/2002 | Kobayashi et al. | 187/414 |
| 6,896,105 | B1 * | 5/2005 | Yamakawa | 187/254 |
| 7,114,594 | B2 * | 10/2006 | Rossignol et al. | 187/336 |

FOREIGN PATENT DOCUMENTS

| | | |
|---|---|---|
| EP | 0 680 921 | 11/1995 |
| EP | 1 174 381 | 1/2002 |
| EP | 1174381 A | 1/2002 |
| JP | 2002003097 A | 1/2002 |
| JP | 2002370885 | 12/2002 |
| JP | 20023708855 A | 12/2002 |
| JP | 2003018569 | 1/2003 |
| SU | 1654214 | 6/1991 |
| WO | WO 02/081353 | 10/2002 |
| WO | WO 02081353 A | 10/2002 |

* cited by examiner

*Primary Examiner*—Jonathan Salata
(74) *Attorney, Agent, or Firm*—Fraser Clemens Martin & Miller LLC; William J. Clemens

(57) ABSTRACT

An elevator monitoring unit and a procedure for maintenance of an elevator monitoring unit include arranging the elevator monitoring unit on at least one door post element which is integrated into the door post, and the door post element is parallel-shifted, to a large extent horizontally, for the purpose of maintenance, repair and diagnostics or is tiltable around a horizontal axis.

14 Claims, 5 Drawing Sheets

Fig. 3
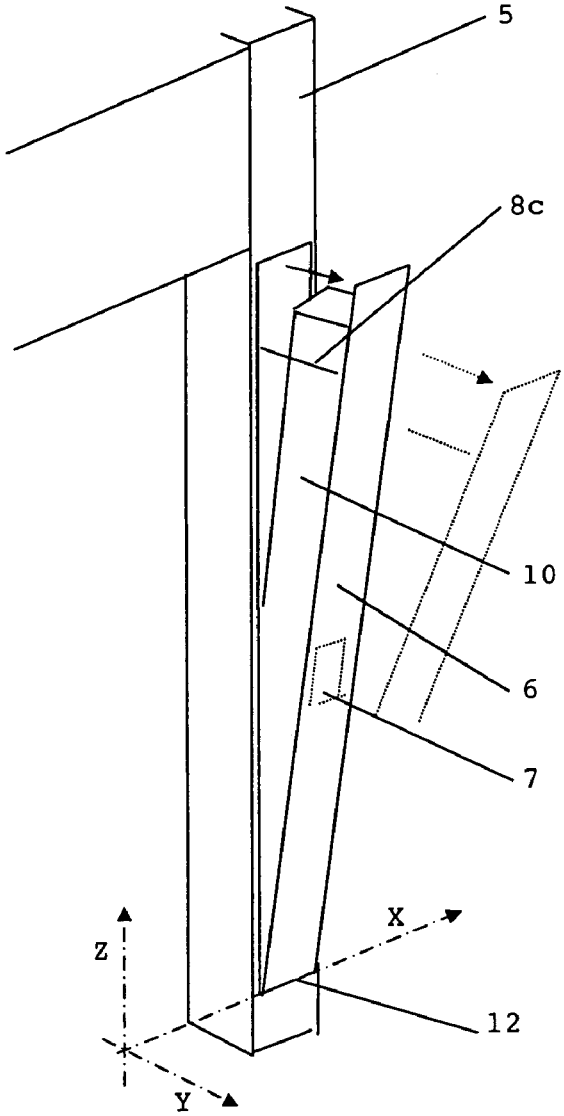
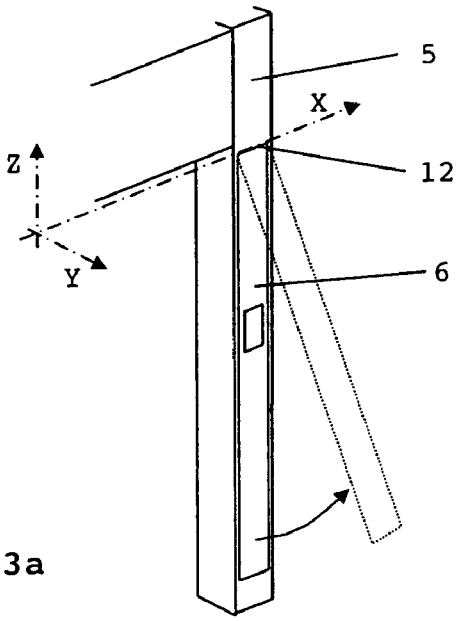
Fig. 3a

ELEVATOR MONITORING UNIT AND PROCEDURE FOR THE MAINTENANCE OF AN ELEVATOR UNIT

BACKGROUND OF THE INVENTION

The present invention concerns an elevator monitoring unit for an elevator hoistway access opening (termination) at a floor.

An elevator monitoring unit comprises the necessary electrical sub-assemblies for the control and regulation of the elevator and particularly of the elevator drive. Furthermore, ordinary elevator monitoring units contain today the interfaces and input modules necessary for maintenance and diagnostics. In case of elevators with no motor room, this elevator monitoring unit is placed advantageously within the area of the elevator hoistway termination.

An elevator hoistway lock enables access from the floor to the car. It consists essentially of movable doors and a door frame fastened in the building, which among other things exhibits at least two vertical door posts.

The installation of electrical devices (or an elevator monitoring unit) in the elevator hoistway termination or in the door post is well-known from the Soviet patent document SU 1 654 214. These solutions were refined with the European patent specification EP 0680921 and the Japanese patent specification JP 03018569. These solutions swivel thereby the door post, or respectively the relevant door post part around a vertical axle to the side.

A disadvantage of this solution is that caused by the swivelling movement a large aperture area is necessary, or the access to the controlling equipment is difficult.

The requisite maintenance works in the elevator monitoring unit cause an unrestricted as possible access to all sub-assembly elements. This causes an accordingly large aperture, which, in the case of the well-known solutions, can be realized only by a large aperture angle with the associated space requirement.

SUMMARY OF THE INVENTION

The present invention underlies the task to suggest an arrangement of the elevator monitoring unit in the hoistway termination, which bypasses the described disadvantages and in particular makes possible a special space saving arrangement of the elevator monitoring unit in the hoistway termination. The placement of the elevator monitoring unit should be possible on each floor, without any change of the installation dimension. The solution should be able to be managed with proven components and procedures of the elevator construction. The production should take place economically and at low costs. The access to the elevator monitoring unit should be safe and simply possible for authorized persons, however it should be able to be protected from the access by unauthorized ones.

The present invention concerns an elevator monitoring unit built into a door post of an elevator hoistway termination comprising: a door post element; an elevator monitoring unit arranged on the door post element; and means for mounting the door post element on an elevator hoistway termination door post, the means for mounting enabling the door post element to be one of parallel-shifted horizontally and tilted around a horizontal axis relative to the door post between a closed position and an open position. In the closed position, the elevator monitoring unit is inside the door post. In the open position, the elevator monitoring unit is accessible for maintenance.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 3 is a view similar to FIG. 2 of a tiltable door post element according to the present invention;

FIG. 3*a* is a view similar to FIG. 3 of a tiltable, self-locking door post element according to the present invention.

DESCRIPTION OF THE PREFERRED EMBODIMENT

Figure 1:
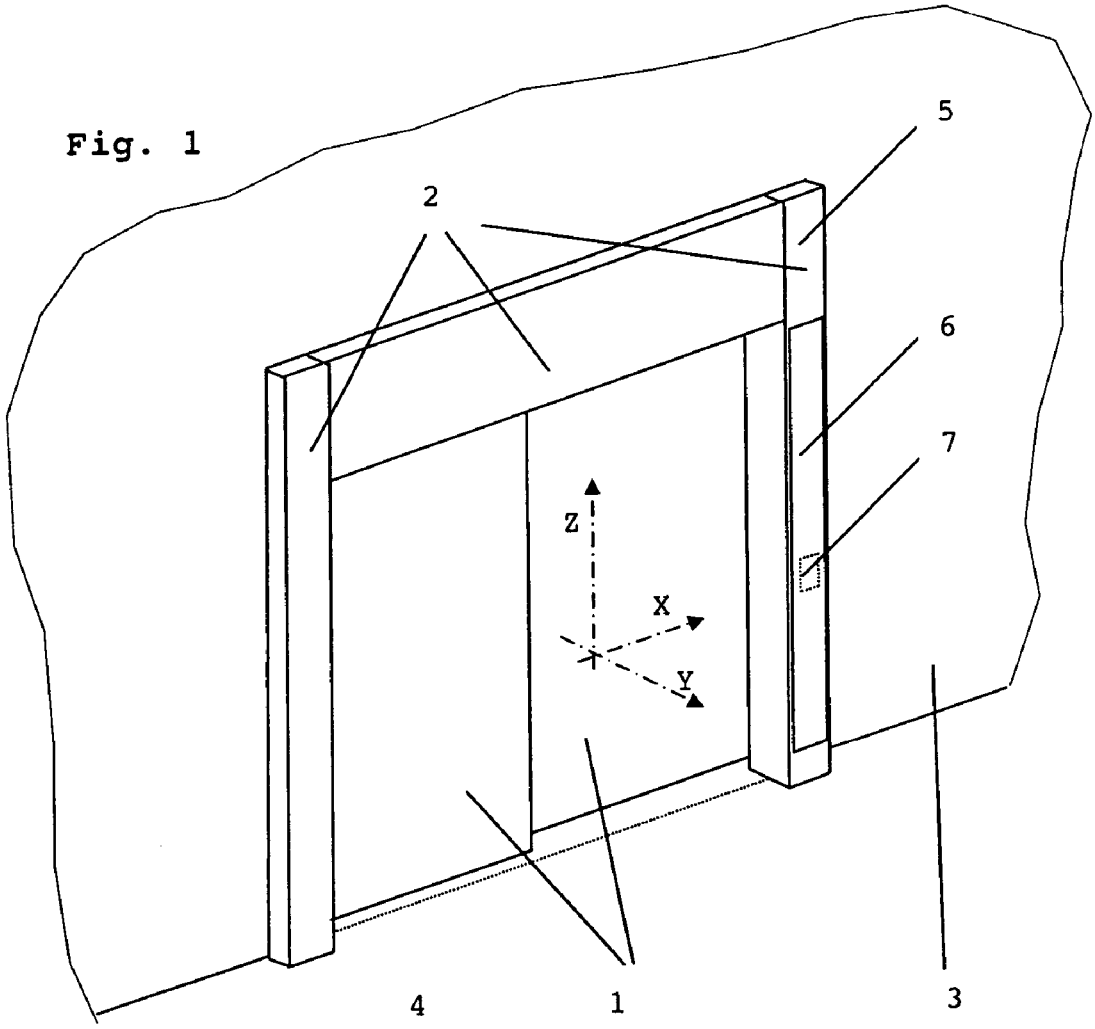
FIG. 1 is a perspective view of an elevator hoistway termination with a door post element according to the present invention at an outer surface of a closing side door post.
Figures 1A, 1B:
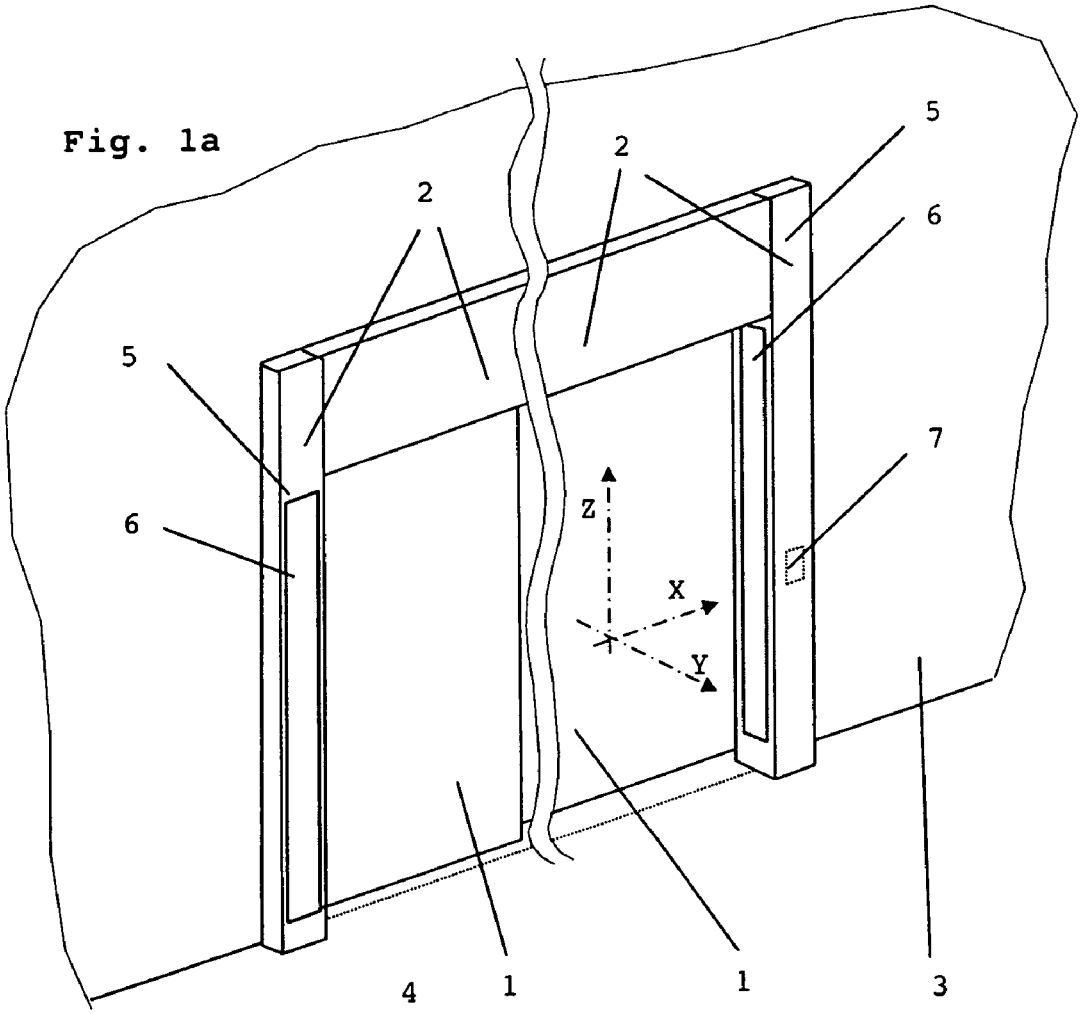
FIG. 1*a* is fragmentary view similar to FIG. 1 with the door post element at an outer surface of an opening side door post.
FIG. 1*b* is a fragmentary view similar to FIG. 1 with the door post element at a side surface of the closing side door post.

As shown in FIGS. 1, 1*a* and 1*b*, an elevator hoistway termination has door panels 1 closing an opening in a wall 3 leading into the hoistway. The opening is surrounded by a frame 2 extending upwardly from a floor 4. The frame 2 includes a pair of vertical door posts 5 at opposite sides of the opening. In FIG. 1, a door post element 6 according to the present invention arranged at an outer surface of a closing side one of the door posts 5. In FIG. 1*a*, the door post element 6 is arranged at an outer surface of an opening side one of the door posts 5. In FIG. 1*b*, a door post element 6' is arranged at a side surface of the closing side door post 5.

Figure 4:
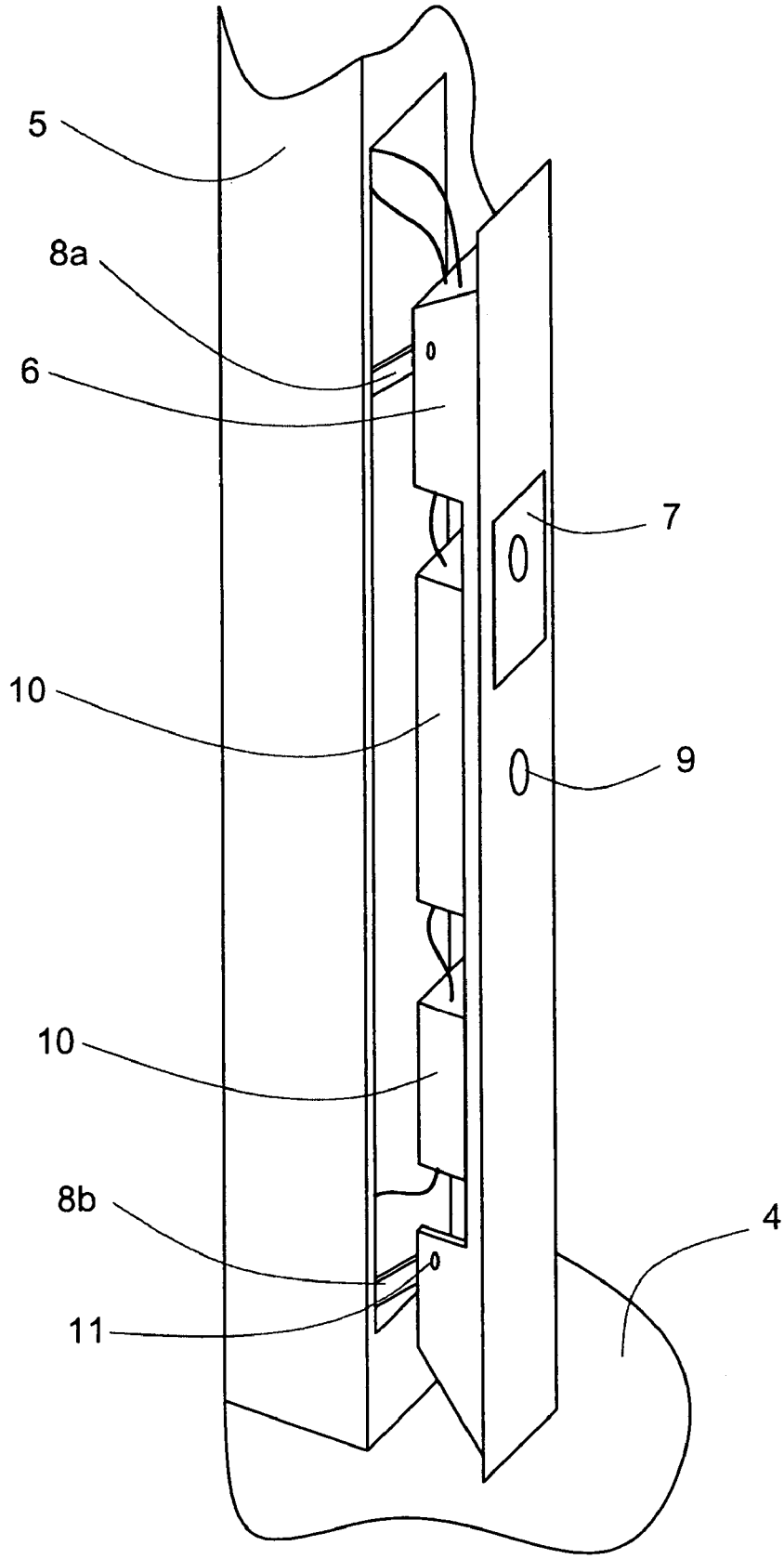
FIG. 4 is a perspective view of a door post with a horizontal parallel movable door post element according to the present invention.

As shown in FIG. 4, an elevator monitoring unit 10 is, according to the present invention, arranged on at least one of the door post elements 6. The door post element 6 is inserted in an opening in an outwardly facing surface or wall of the door post 5. The door post element 6 can be opened from the door post 5 and makes possible, in this condition, the access to the elevator monitoring unit 10. In the closed condition, the elevator monitoring unit 10 is not accessible from the outside. The attachment of the door post element 6 in the door post 5 is in such a manner executed that the door post 6 can be parallel-shifted to a large extent along a horizontal axis "Y" (FIGS. 2, 2*a* and 2*b*) or be tilted around a horizontal axis "X" (FIGS. 3 and 3*a*). On this occasion, the elevator monitoring unit 10 is usually installed on the door post element 6, in the ideal case during the construction work, and extensively cabled.

The represented solution permits an economic production. The solution permits a simple, safe and fast access to the elevator monitoring unit 10 for the purpose of maintenance, repair, and diagnostics or for special purposes. Special purposes are all interventions as for example fire-brigade operation, emergency evacuation or electric network controls.

The installation of the elevator monitoring unit 10 can, in case of need, be divided between several door post elements 6 or arranged at other places, if due to the space requirement, the accessibility, or the functional separation of the elevator monitoring unit 10, this is judged as meaningful. Parts of the elevator monitoring unit 10, for which the fast access is of subordinated importance, are placed in the rule according to their function. So, for example, the transformer, belonging to the elevator driving gear, can be placed with the elevator drive, and only the command module is located on the door post element 6.

Figure 2:
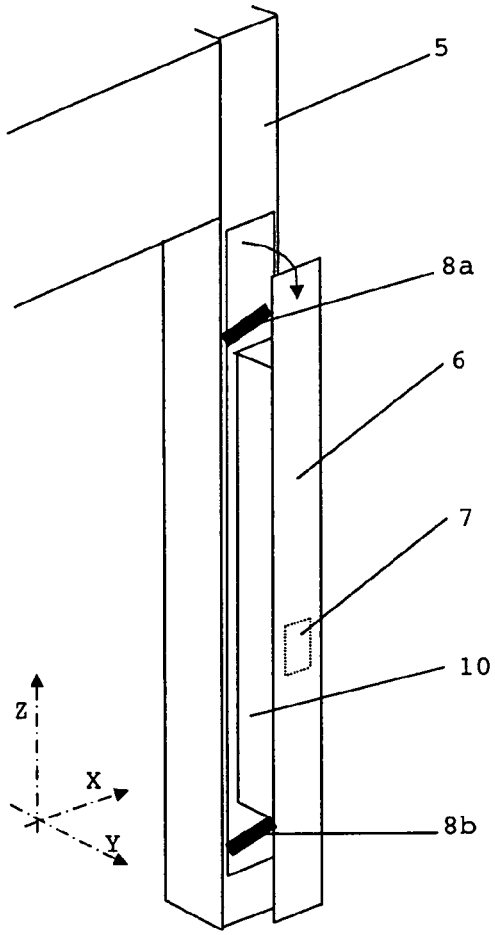
FIG. 2 is an enlarged exploded view of the parallel movable door post element shown in FIG. 1.
Figure 2A:
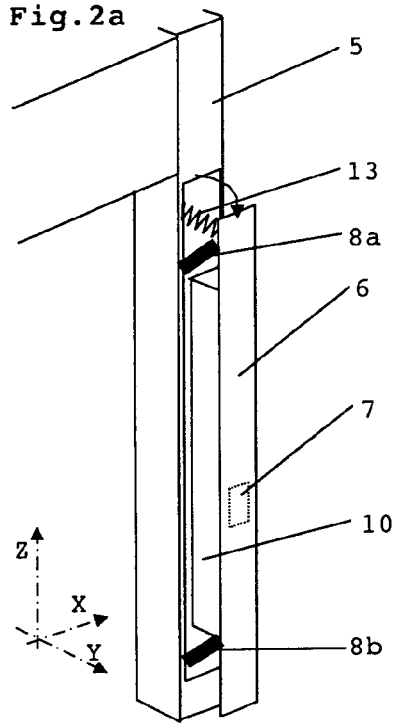
FIG. 2*a* is a view similar to FIG. 2 of the parallel movable door post element with a locking spring according to the present invention.
Figure 2B:
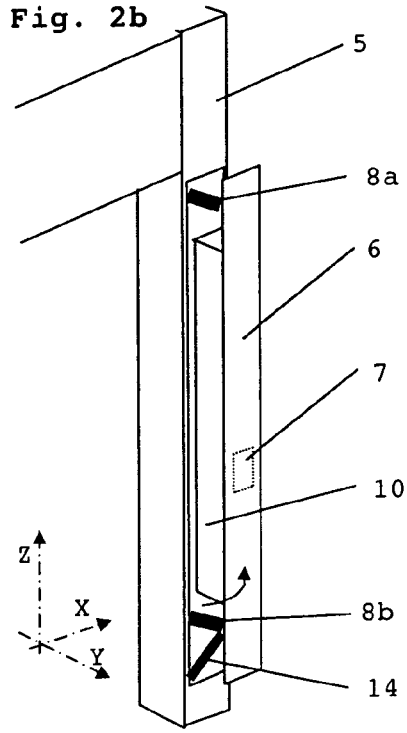
FIG. 2*b* is a view similar to FIG. 2 of the parallel movable door post element with a stopping lever.

In a preferred variant shown in FIGS. 2, 2*a* and 2*b*, the attachment of the door post element 6 is executed as a parallelogram with two levers 8*a*, 8*b* each arranged within a lower and an upper door jamb range. The closed position of the door post element 6 is placed thereby preferably slightly behind the upper vertex position (tilting point) of the lever system formed by the lever arrangement. The closed position of the door post element 6 is usually secured with a locking device 9 (FIG. 4). The door post element 6 forms, in this closed situation and from the user desired, an aesthetic and as pleasantly constructed line or surface with the door post 5. The locking device 9 forms a possibility to protect the elevator monitoring unit 10 against unauthorized access, however at the same time of simply permitting the access for authorized users.

When opening, the door post element 6 is moved together with the mounted elevator monitoring unit 10 according to the lever geometry (8*a*, 8*b*) parallel outwards and downwards, until the movement is delimited by the floor 4 or by an integrated stop motion device 11 (FIG. 4). The lever geometry is displayed in such a manner that the elevator monitoring unit 10 is in such a manner accessible for the necessary interventions such that a fast and safe execution of the necessary works, such as maintenance, repair, service and diagnostics or special purposes, becomes possible. Because of the favorable parallel shift in the "Y" and "Z" directions, with the opening of the door post element 6 from the door post 5 is the necessary space requirement for the access minimal. In the represented example, it amounts to approximately 0.15 m in the "Y" direction.

The door post element 6 is structurally in such a manner arranged that, in the opened position of the door post element 6, the components of the elevator monitoring unit 10 are accessible from two sides. This execution improves the accessibility for the necessary interventions.

In another variant, the parallelogram described above is replaced by a tilting mechanism 12, whereby the door post element 6 is mounted at the bottom in a pivoting manner (FIG. 3) without the lever, and the tilting motion is by the rotation of the upper end of the door post. The opening distance can be defined thereby by a linkage, an extension joint bar 8*c* or an outside tilting delimitation. This solution permits a low-cost execution in comparison to the previous described variant, since the lower levers are omitted.

A further variant has an opening mechanism that results in the door post element 6 being self-locking. This is achieved, for example, as the door post element 6 is held in its closed position by means of a locking spring 13 (FIG. 2*a*). In an opened condition, the door post element 6 is fixed by means of a locking device. The locking device can be a stopping lever, or be the locking spring 13 itself, for example by means of a break-over point arrangement as shown in FIG. 2*a*, in such a manner arranged that the door post element 6 is held in the opened position and is pulled into the closed position after the introduction of the closing process. Alternatively, the arrangement shown in the FIGS. 2 and 3 can be inverted as it appears from the FIGS. 2*b* and 3*a* respectively. So the lever geometry 8*a*, 8*b* can be arranged in such a manner that the door post element 6 is moved parallel outwards and upwards (FIG. 2*b*), whereby it falls, in case of load alleviation, autonomously into its lower, closed situation, or the alternatively shown tilting mechanism 12 is provided with an axis of rotation (FIG. 3*a*) located at the top. With these solutions, a locking device is necessary, the locking device being for example in the form of a locking lever 14, which holds the door post element 6 in the opened position. The described alternatives represent individual solutions to the closing and opening mechanics of the door post element.

In another variant, a floor indicator board 7 is integrated directly into the door post element 6.

The execution of the elevator monitoring unit 10 is in such a preferred manner arranged that the dimension given by the entrance height of the hoistway termination is used and thus, the elevator monitoring unit 10 can be arranged to a large extent completely within the door post 5. In the example shown, the height of the door post element 6 amounts to approximately 1.3 m with a width of approximately 0.12 m. Through this space-saving arrangement, an optimal utilization of the building area in the door post 5 is reached, whereby a flexible arrangement of the elevator monitoring unit 10 is made possible independently of the door post dimensions at each floor. The position requirement for the individual floor is independent from the arrangement of the elevator monitoring unit 10.

In the FIGS. 2 to 4, the door post element 6 with the elevator monitoring unit 10 is shown as parallel-shifted horizontally ("Y" direction) or tiltable around a horizontal axis ("X" direction). In an alternative arrangement, as shown in FIG. 1*b*, the door post element 6' with the elevator monitoring unit 10 is built in turned at 90° around a vertical axis ("Z"). It is horizontal, in this arrangement and can be parallel-shifted in the "X" direction or can be mounted tiltable around the horizontal axis ("Y"). This arrangement offers advantages in the configuration of the door frames, as for example the front surface of the door posts 6 can be round, skewed or being of any form.

By the attachment of a fireproof assembling box in the door post 5, the necessary fire-protective class of the concerned hoistway termination can be ensured without restriction.

With knowledge of the present invention, the man skilled in the art can change the set sizes and arrangements at will. For example, the space requirement shown can appropriately be increased or made smaller by 0.15 m.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator monitoring unit built into a door post of an elevator hoistway termination comprising:

a door post element;

an elevator monitoring unit arranged on said door post element; and means for mounting said door post element on an elevator hoistway termination door post, said means for mounting enabling said door post element to be one of parallel-shifted horizontally and tilted around a horizontal axis relative to the door post for movement between a closed position wherein said elevator monitoring unit is inside the door post and an open position wherein said elevator monitoring unit is accessible for maintenance.

2. The elevator monitoring unit according to claim 1 wherein said means for mounting includes guide levers arranged at a top and at a bottom of said door post element whereby when said door post element is mounted on the door post said door post element is parallel-guided by said guide levers to be parallel-shifted horizontally.

3. The elevator monitoring unit according to claim 2 wherein the closed position of said door post element relative to the door post is at a tilting point of said guide levers.

4. The elevator monitoring unit according to claim 1 wherein said door post element is tiltable around a pivot point of a tilting mechanism arranged at one of a bottom and a top of said door post element.

5. The elevator monitoring unit according to claim 1 including at least one of a locking device, a locking spring and a locking lever attached to said door post element for locking to the door post in the closed position of said door post element.

6. The elevator monitoring unit according to claim 1 wherein the open position of said door post element is limited by one of touch-down on a floor, an extension joint bar and a stop motion device.

7. The elevator monitoring unit according to claim 1 wherein said door post element is self-locking at the door post.

8. The elevator monitoring unit according to claim 1 wherein said elevator monitoring unit is accessible in the open position of said door post element from at least two sides of said door post element.

9. The elevator monitoring unit according to claim 1 including a floor indicator board integrated into said door post element.

10. The elevator monitoring unit according to claim 1 wherein said elevator monitoring unit is positioned within the door post when said door post element is in the closed position.

11. The elevator monitoring unit according to claim 1 wherein a height of said door post element is a multiple of a width of said door post element.

12. The elevator monitoring unit according to claim 1 wherein said door post element in the closed position and door post form a fireproof box.

13. An elevator monitoring unit built into a door post of an elevator hoistway termination comprising:

a pair of door post elements;

an elevator monitoring unit having portions arranged on each of said door post elements; and means for mounting said door post elements on associated elevator hoistway termination door posts, said means for mounting enabling said door post elements each to be one of parallel-shifted horizontally and tilted around a horizontal axis relative to the associated door post between a closed position whereby the elevator monitoring unit portions are inside the associated door posts and an open position whereby the elevator monitoring unit portions are accessible for maintenance.

14. A method for maintenance of an elevator monitoring unit built into a door posts of an elevator hoistway termination comprising:

providing a door post element;

providing an elevator monitoring unit and arranging the elevator monitoring unit on the door post element; and mounting the door post element on an elevator hoistway termination door post for at least one of parallel-shifted generally horizontal movement of the door post element relative to the door post and tilting around a generally horizontal axis movement of the door post element relative to the door post, the movement being between a closed position with the elevator monitoring unit inside the door post and a open position whereby the elevator monitoring unit is accessible for maintenance.

* * * * *

UNITED STATES PATENT AND TRADEMARK OFFICE

CERTIFICATE OF CORRECTION

PATENT NO. : 7,398,861 B2
APPLICATION NO. : 11/131542
DATED : July 15, 2008
INVENTOR(S) : Eric Rossignol et al.

It is certified that error appears in the above-identified patent and that said Letters Patent is hereby corrected as shown below:

On the title page insert item (63), This application is a CON of PCT/CH03/00730 11/07/2003

Signed and Sealed this

Fourteenth Day of October, 2008

JON W. DUDAS
*Director of the United States Patent and Trademark Office*